United States Patent [19]

Johnson

[11] 4,298,813

[45] Nov. 3, 1981

[54] HIGH INTENSITY DISCHARGE LAMPS WITH UNIFORM COLOR

[75] Inventor: Peter D. Johnson, Schenectady, N.Y.

[73] Assignee: General Electric Company, Schenectady, N.Y.

[21] Appl. No.: 953,582

[22] Filed: Oct. 23, 1978

[51] Int. Cl.[3] ..... H01J 61/20

[52] U.S. Cl. ..... 313/229

[58] Field of Search ..... 313/225, 227, 229

[56] References Cited

U.S. PATENT DOCUMENTS

| | | | |
|---|---|---|---|
| 3,384,775 | 5/1968 | Ishler et al. | 313/225 |
| 3,654,506 | 4/1972 | Kühl et al. | 313/225 X |
| 3,781,586 | 12/1973 | Johnson | 313/229 X |
| 3,911,308 | 10/1975 | Akutsu et al. | 313/229 X |
| 3,958,145 | 5/1976 | Jack et al. | 313/225 X |
| 4,155,025 | 4/1978 | Dobrusskin et al. | 313/225 X |

*Primary Examiner*—Palmer C. Demeo

*Attorney, Agent, or Firm*—Nathan D. Herkamp; James C. Davis, Jr.; Paul R. Webb, II

[57] ABSTRACT

The amount of mercury used in a metal halide-mercury arc discharge lamp is controllably selected to produce a voltage gradient along the arc discharge of between approximately 2 v/cm and approximately 10 v/cm. When such a lamp is operated vertically, the usually observed color separation does not occur. Even though this voltage gradient is substantially less than the conventional gradient employed in such lamps, no significant loss of efficacy occurs.

3 Claims, 1 Drawing Figure

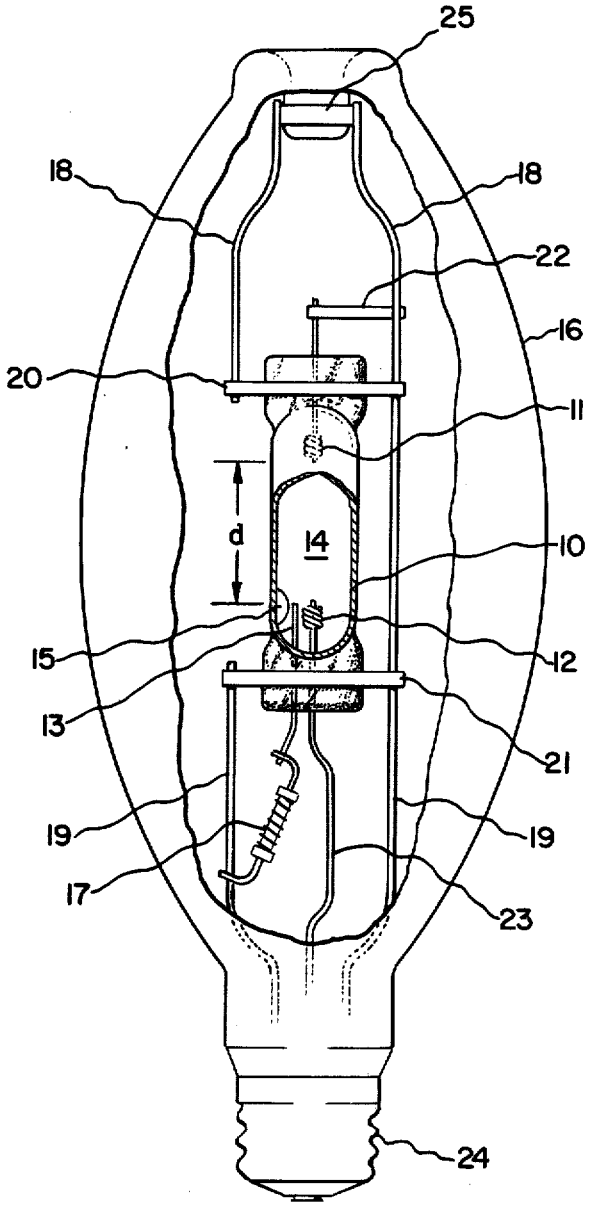
25
18
18
22
16
20
11
d
14
10
15
12
13
21
19
19
17
23
24

HIGH INTENSITY DISCHARGE LAMPS WITH UNIFORM COLOR

BACKGROUND OF THE INVENTION

This invention relates to high intensity arc discharge lamps and particularly to metal halide-mercury lamps operated in a vertical position.

One of the serious problems that occurs in halide-mercury high intensity discharge lamps is the separation of color which results when the arc of the lamp is positioned in a vertical or nearly vertical position. Typically, in the higher wattage, physically longer lamps containing a sodium halide as one of the ingredients, the orange color of the sodium radiation appears predominately at the bottom of the discharge arc, leaving the radiation of other ingredients, including mercury, which is generally blue or blue-green, in the upper portion of the discharge arc. These lamps are typically operated at a positive column arc gradient of between approximately 25 and 35 v/cm. The color separation results in uneven distribution of color in the area being illuminated and in addition is accompanied by substantial loss of luminous efficacy.

SUMMARY OF THE INVENTION

In accordance with a preferred embodiment of the present invention, the amount of mercury used in the discharge tube of metal halide-mercury arc lamps is controllably selected so that the positive column arc gradient is between approximately 2 v/cm and approximately 10 v/cm. Within this range, the range from approximately 5 v/cm to approximately 10 v/cm is preferred so as to optimize the combination of luminous efficacy and color uniformity along the arc discharge. The lamps of the present invention may be operated in a vertical or near vertical position without the previously observed color separation.

DESCRIPTION OF THE DRAWING

The FIGURE illustrates a metal halide-mercury discharge lamp typically employed in the present invention.

DETAILED DESCRIPTION OF THE INVENTION

The FIGURE illustrates a typical metal halide-mercury arc discharge lamp to which the present invention is directed. Light-transmissive discharge tube 10 possesses electrodes 11 and 12 disposed at opposed ends thereof, said electrodes 11 and 12 protruding into the gaseous discharge medium 14 typically comprising a mixture of a metal halide vapor and mercury vapor. The mercury vapor pressure within the discharge envelope 10 occurs as a result of the presence of mercury globule 15. A quantity of one or more metal halides is also introduced which condenses on the envelope walls when the arc is turned off. The amount of mercury present controls the positive column discharge voltage gradient along the electrical discharge flowing between electrodes 11 and 12.

Also, typically present in such lamps is starting electrode 13 electrically connected to one side of starting resistor 17, the other side of which is electrically connected to the electrode 11 through supporting members 19, 21, 18, and 22. Electrode 11 is connected by means of supporting members 22, 18, and 19 to one side of the electric power supply for the lamp. The discharge envelope 10 is supported within an outer envelope 16 by means of support rods or wires 19 which are typically spot welded to metal band member 21 at the base end of the lamp. At the end of the lamp, opposite the base 24, the discharge tube 10 is supported by rod or wire members 18 and metal band member 20. Metal strap 22 typically connects electrode 11 electrically with one side of the power supply for the lamp, the other side of the power supply being connected by means of wire or rod 23 which is connected to electrode 12, the base-end electrode. Support members 18 are typically supported by spot welding to metal band 25 surrounding a dimple in the end of the lamp distal from the base 24 which is often an Edison type base or a bayonet type base. The Edison type base is shown. The connections of the supporting members are typically made with one another by means of spot welds. A more detailed description of such lamps is found in U.S. Pat. No. 3,781,586, issued Dec. 25, 1973 to Peter D. Johnson, the applicant herein, and assigned to the same assignee as this invention. This patent is hereby incorporated herein by reference as background material.

Conventional high intensity discharge lamps employing metal halide-mercury vapor operate with a voltage gradient along the arc discharge of between approximately 25 v/cm and approximately 35 v/cm. As seen in the FIGURE, the distance d between electrodes 11 and 12 is divided into the voltage difference between electrodes 11 and 12 to determine this voltage gradient, commonly referred to as the positive column voltage gradient. However, it is observed in such conventional lamps that color separation occurs along the arc discharge. That is, when the lamp is operated in vertical position, the lower portion of the discharge exhibits a predominately orange radiation while the upper portion of the discharge emits blue or blue-green radiation. This problem is most prevalent in the higher wattage lamps having a relatively long discharge length, d. Also, in conventional higher wattage lamps, the arc is often unstable and swirls when operated vertically.

The positive column voltage gradient is controllable by selecting the amount of mercury to be used in the discharge envelope 10. As the conventional amounts of mercury employed are reduced, the voltage gradient likewise is reduced but the discharge current increases. Conventional metal-halide mercury arc discharge lamps are not operated with these reduced amounts of mercury, and therefore lower mercury vapor pressure because the increased current that results used to be very difficult to regulate with standard ballasts and the high current also had a severely deleterious effect upon the discharge electrodes. However, improvements in electrode construction and ballast now permit the operation of such lamps at relatively high currents.

In accordance with a preferred embodiment of the present invention, the amount of mercury employed in the discharge envelope 10 is selected so that the positive column arc voltage gradient is between approximately 2 v/cm and approximately 10 v/cm instead of between the usual 25 to 35 v/cm. Within the aforementioned range of operation, the preferred range of voltage gradients for optimizing the combination of luminous efficacy and color uniformity is between approximately 5 v/cm and approximately 10 v/cm. Below this range, loss of efficacy occurs and above this range, color separation is observed when the lamp is operated in a vertical position. Even though the lower mercury vapor pressure results in higher current in the discharge, this is no longer a serious problem considering the present state of the art in electrode construction and materials and ballast components. The optimum arc potential gradient depends to some extent on the arc tube dimension, but nonetheless, the range from between approximately 2 v/cm and 10 v/cm is preferred to achieve color uniformity along the entire arc discharge.

When constructed and operated in accordance with the present invention, high intensity discharge metal halide-mercury arc discharge lamps exhibit a uniform color of radiation along the entire discharge length. Additionally, lamps of the present invention have a stable arc which is not subject to the swirling phenomenon observed in conventional discharge lamps when they are operated vertically.

By way of example, and not limitation, a metal halide-mercury arc discharge lamp may be constructed in accordance with the following specifications. For example, the arc discharge tube may comprise a light-transmissive quartz envelope with electrodes disposed therein at a separation distance, d, of 9 cm. The inside diameter of the discharge envelope is approximately 2.2 cm and the internal volume of the envelope comprises approximately 35 $cm^3$. Within the volume, various metal halides and metal halide mixtures may be included. A particularly useful halide mixture may comprise, for example, approximately 25 mg of a mixture of sodium iodide (NaI), thallium iodide (TlI) and indium iodide (InI), said iodides being included in a proportion giving good color rendition in the absence of color separation. Another useful halide mixture for example comprises approximately 25 mg of a mixture containing 5 mole percent of NaI and 95 mole percent of scandium iodide ($ScI_3$). A starting gas is also included within the envelope and comprises, for example, argon at a pressure of approximately 20 torr. The amount of mercury to be added depends upon the desired voltage gradient. Thus, for a voltage gradient of approximately 10 v/cm, 60 mg of mercury are included in the discharge envelope (that is, approximately 1.7 $mg/cm^3$). For a voltage gradient of approximately 5 v/cm, 25 mg of mercury are included (that is, approximately 0.7 $mg/cm^3$). This level of mercury is appropriate for either of the aforementioned metal halide mixtures. Such a lamp would typically be operated at a power level of approximately 1,000 watts.

Accordingly, from the above, it will be appreciated that the arc discharge lamp of the present invention and the method of operating it described above provides a simple and inexpensive method of achieving color uniformity along the arc discharge when the discharge lamp is operated in a vertical or near vertical position.

While this invention has been described with reference to particular embodiments and examples, other modifications and variations will occur to those skilled in the art in view of the above teachings. Accordingly, it should be understood that the appended claims are intended to cover all such modifications and variations as fall within the true spirit of the invention.

The invention claimed is:

1. A method of operating metal halide-mercury arc discharge lamps so as to reduce color nonuniformity in vertically operated lamps, comprising:

providing elemental mercury in said lamp in quantity sufficient to produce a concentration of between approximately 0.7 $mg/cm^3$ and approximately 1.7 $mg/cm^3$, so that a voltage gradient is produced along the arc discharge of between approximately 2 v/cm and approximately 10 v/cm.

2. A metal halide-mercury arc discharge lamp including a light-transmissive discharge envelope having electrodes disposed at either ends thereof, comprising:

a metal halide disposed within said envelope; and a quantity of elemental mercury also disposed within said envelope, and selected to be at a concentration of between approximately 0.7 $mg/cm^3$ and approximately 1.7 $mg/cm^3$, so that the voltage gradient along the discharge is between approximately 2 v/cm and approximately 10 v/cm.

3. A metal halide-mercury arc discharge lamp including a light-transmissive discharge envelope having electrodes disposed at either ends thereof, comprising:

at least one metal halide disposed within said envelope, said halide selected from the group consisting of sodium iodide (NaI), thallium iodide (TlI), indium iodide (InI), and scandium iodide ($ScI_3$); and a quantity of elemental mercury also disposed within said envelope, said quantity of mercury selected to be at a concentration of between approximately 0.7 $mg/cm^3$ and approximately 1.7 $mg/cm^3$, so that the voltage gradient along the discharge is between approximately 2 v/cm and approximately 10 v/cm.

* * * * *